United States Patent [19]

Inoue et al.

[11] Patent Number: 4,660,520

[45] Date of Patent: Apr. 28, 1987

[54] APPARATUS FOR THROTTLE VALVE CONTROL

[75] Inventors: Hideaki Inoue, Yokosuka; Shinji Katayose, Tokyo; Akira Takei, Yokosuka; Takashi Oka, Tokyo, all of Japan

[73] Assignee: Nissan Motor Company, Limited, Yokohama, Japan

[21] Appl. No.: 853,873

[22] Filed: Apr. 21, 1986

[30] Foreign Application Priority Data

Jun. 4, 1985 [JP] Japan ..... 60-120800

[51] Int. Cl.[4] ..... F02D 41/04

[52] U.S. Cl. ..... 123/399; 123/403

[58] Field of Search ..... 123/396, 399, 403, 361

[56] References Cited

U.S. PATENT DOCUMENTS 4,401,075 8/1983 O'Keefe, Jr. et al. ..... 123/403

4,419,973 12/1983 Collonia ..... 123/399

4,508,078 4/1985 Takeuchi et al. ..... 123/403

4,546,736 10/1985 Moriya et al. ..... 123/399

*Primary Examiner*—William A. Cuchlinski, Jr.

*Attorney, Agent, or Firm*—Schwartz, Jeffery, Schwaab, Mack, Blumenthal & Evans

[57] ABSTRACT

An apparatus responsive to a change in the position of an accelerator pedal for controlling movement of a throttle valve situated within an induction passage. The apparatus includes a control circuit which determines new and minimum values for the position of the accelerator pedal and determines a demand value corresponding to a setting of the position of the throttle valve as a function of the difference between the new and minimum values. The control circuit substitutes the new value for the minimum value when the accelerator pedal remains released and placed at the same position for a predetermined time.

12 Claims, 9 Drawing Figures

APPARATUS FOR THROTTLE VALVE CONTROL

BACKGROUND OF THE INVENTION

This invention relates to an apparatus for controlling movement of a throttle valve in response to a change in the position of an accelerator and, more particularly, to a throttle valve control apparatus which can absorb errors occuring upon attaching an accelerator position sensor.

In order to meter the amount of air to an internal combustion engine, a variable positionable throttle valve is situated within the induction passage of the engine. Normally, a mechanical link mechanism is provided to couple the throttle valve to an accelerator pedal in a manner to move the throttle valve in response to movement of the accelerator pedal. In order to control the throttle valve in a special fashion in response to movement of the accelerator pedal, it has been proposed to substitute an electrical servo control system for the mechanical link mechanism. Such an electrical servo control system includes a potentiometer which converts the movement of the accelerator pedal into a corresponding electric signal which is electrically processed to drive an actuator which thereby moves the throttle valve to a position corresponding to the new position of the accelerator pedal. Therefore, the control accuracy is greatly dependent on the degree of accuracy of attachment of the potentiometer.

Accordingly, it is the problem in the art to provide the degree of accuracy required in controlling the movement of the throttle valve while minimizing the labor and time required in attaching an accelerator pedal position sensor.

SUMMARY OF THE INVENTION

There is provided, in accordance with the present invention, an apparatus for use with an internal combustion engine having an accelerator, a throttle valve situated within an induction passage, and a brake pedal for controlling movement of the throttle valve in response to a change in the position of the accelerator. The apparatus includes first and second signal sources. The first signal source generates a first electrical signal indicative of the position of the accelerator pedal. The second signal source generates a second electrical signal indicative of the accelerator being released. A control circuit is responsive to the first signal for determining an existing value for accelerator position and a minimum value for accelerator position. The control circuit includes means for determining a demand value corresponding to a setting of the position of the throttle valve as a function of a difference between the existing and minimum values. A throttle valve actuator is connected to the control circuit for moving the throttle valve to the determined setting. The control circuit includes means responsive to the first and second signals for substituting the existing value for the minimum value when the accelerator remains released and placed at the same position for a predetermined time.

Therefore, the present invention provides a throttle valve control apparatus which can absorb errors occuring in attaching an accelerator position sensor to provide a high degree of accuracy of throttle valve control.

BRIEF DESCRIPTION OF THE DRAWINGS

This invention will be described in greater detail by reference to the following description taken in connection with the accompanying drawings, in which.

DETAILED DESCRIPTION OF THE PREFERRED EMBODIMENT

Figure 1:
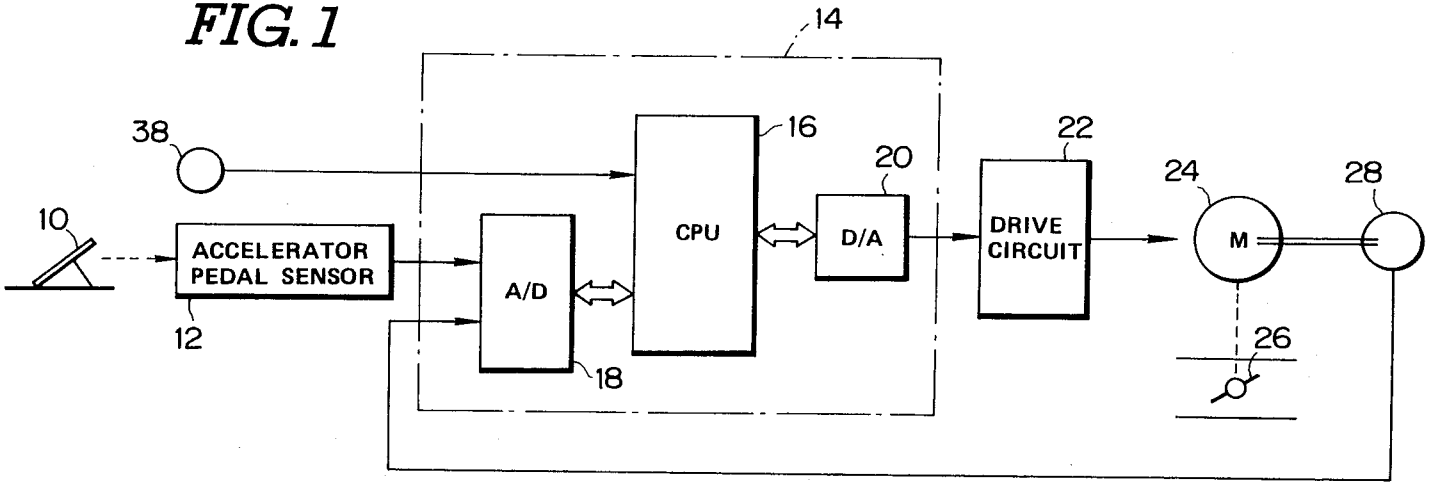
FIG. 1 is a schematic diagram showing one embodiment of a throttle valve control apparatus made in accordance with the present invention.
Figure 2:
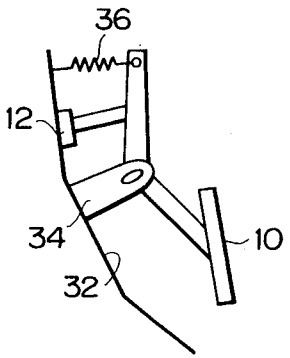
FIG. 2 is a schematic side view used to explain the position of the accelerator pedal position sensor used in the control circuit of FIG. 1.

With reference to the drawings and in particular to FIG. 1, there is shown a schematic block diagram of a throttle valve control system embodying the present invention. The throttle valve control system includes an accelerator pedal 10. As shown in FIG. 2, the accelerator pedal 10 is pivoted by a bracket 34 on an automobile floor panel 32. A return spring 36 is placed between the accelerator pedal and the floor panel to urge the accelerator pedal 20 in a direction toward its fully released position. An accelerator pedal position sensor 12, mounted on the floor panel 32, generates an analog signal V1 corresponding to the amount of depression of the accelerator pedal 10. The accelerator pedal position sensor 12 includes a potentiometer connected between a voltage source and electrical ground. The resistance of the potentiometer is a function of the extent to which the accelerator pedal 10 is depressed. The wiper arm of the potentiometer is operatively connected to the accelerator pedal 10 to change the resistance value of the potentiometer as the accelerator pedal moves between its fully released and depressed positions. The analog signal V1 is applied from the accelerator pedal position sensor 12 to a control circuit 14.

Figure 3:
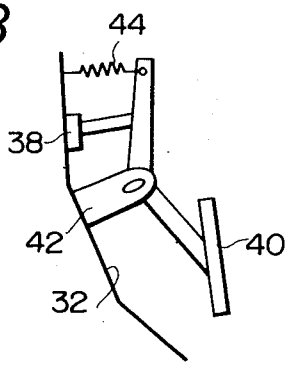
FIG. 3 is a schematic side view used to explain the position of the brake switch used in the control circuit of FIG. 1.

The throttle valve control system also includes a brake switch 38 which is associated with a brake pedal 40. As shown in FIG. 3, the brake pedal 40 is pivoted by a bracket 42 on the floor panel 32. A return spring 44 is placed between the brake pedal and the floor panel to urge the brake pedal 40 in a direction toward its fully released position. The brake switch 38 is mounted on the floor panel 32 and effective to generate an on-off signal V3. The brake switch 38 is responsive to the application of braking to the vehicle to close to supply an on signal to the control circuit 14.

A variable positionable throttle valve 26, mounted for rotation with a throttle shaft, is situated within an induction passage and effective for controlling the flow of air to the engine. A bi-directional control motor 24 such for example as a stepper motor has a motor shaft which is drivingly coupled to the throttle shaft, as indicated by the broken line. The control motor 24 functions to vary the position of the throttle valve 26 in a manner as described later. The control motor 24 is electrically controlled and it determines the setting of the throttle valve 26 which, in turn, determines the amount of air admitted to the engine. A throttle valve position sensor 28 is provided for generating an analog signal V2 corresponding to the degree of opening of the throttle valve 26. The throttle valve position sensor 28 may include a potentiometer having a wiper arm operatively connected to the control motor 24 to change the resistance value of the potentiometer as the control motor 24 rotates to move the throttle valve 26.

The control circuit 14 determines the required new setting, at a given time, of the throttle valve position. The actual setting of the throttle valve is accomplished with the control motor 24 and its drive circuit 22. The control circuit 14 produces a control signal to the drive circuit 22 for controlling the direction and degree of motion of the bi-directional control motor 24. The control circuit 14 determines new and minimum values for the position of the accelerator position 10 and determines a demand value corresponding to a setting of the position of the throttle valve as a function of the difference between the new and minimum values. The control circuit 14 substitutes the new value for the minimum value when the accelerator remains released and placed at the same position for a predetermined time.

The control circuit 14 may employ a digital computer which shall be regarded as including an analog-to-digital converter 18, a central processing unit 16, a memory, a timer, and a digital-to-analog converter 20. The analog-to-digital converter 18 receives an analog signal V1 from the accelerator pedal position sensor 12 and also an analog signal V2 from the throttle valve position sensor 28 and converts the received signals into corresponding digital signals for application to the central processing unit 16. The memory contains the program for operating the central processing unit and further contains appropriate data in look-up tables used in calculating appropriate values for the position of the throttle valve 26. The look-up data may be obtained experimentally or derived empirically. The central processing unit may be programmed in a known manner to interpolate between the data at different entry points if desired. Control words specifying a desired throttle valve position are periodically transferred by the central processing unit 16 to the digital-to-analog converter 20. The digital-to-analog converter 20 converts the transferred information into analog form and applies a control signal to the drive circuit 22 for controlling the direction and degree of motion of the control motor 24.

Figure 4:
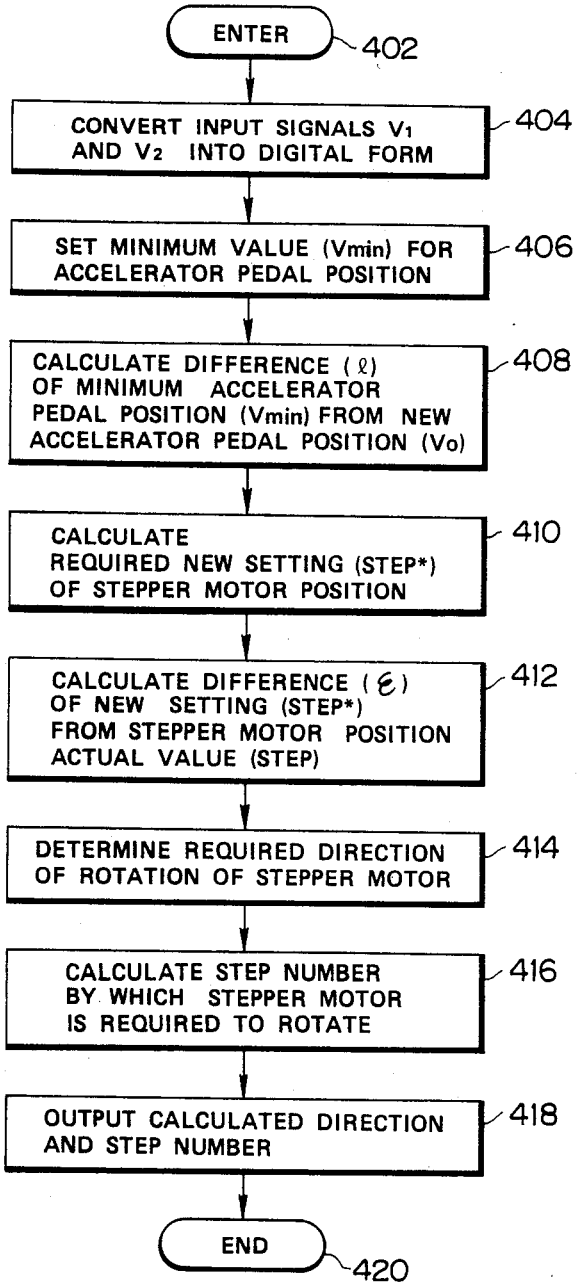
FIG. 4 is a flow diagram illustrative of the operation of the digital computer used to calculate values for the stepper motor used to control the position of the throttle valve.
Figure 5:
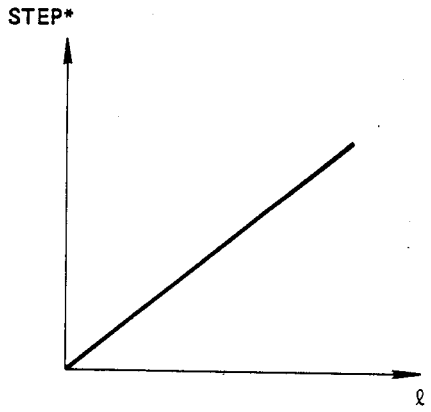
FIGS. 5 and 6 are graphs showing relationships used in calculating throttle valve position demand values.

FIG. 4 is an overall flow diagram of the programming of the digital computer. The computer program is entered at the point 402 at constant time intervals, for example, of 5 milliseconds in this embodiment. At the point 404 in the program, the accelerator-pedal and stepper-motor position signals V1 and V2 are, one by one, converted by the analog-to-digital converter 18 and read into the computer memory. The computer memory stores twenty accelerator pedal position values read in sequence. The oldest accelerator pedal position value is removed when a new accelerator pedal position value (Vo) is stored. At the point 406, a minimum value (Vmin) for the position of the accelerator pedal 10 is set in the computer memory. At the point 408, the computer central processing unit 16 calculates the difference (λ) of the minimum value (Vmin) from the new value (Vo). This difference (λ) indicates the degree of depression of the accelerator pedal 10 with respect to the minimum degree of position of the accelerator pedal. At the point 410, the central processing unit calculates a required new setting in terms of the number of steps (STEP*) by which the stepper motor 24 is required to rotate so as to bring the throttle valve to a new setting position. This calculation is made from a relationship programmed into the computer. This relationship is shown in FIGS. 5 or 6 and it defines required new stepper motor step number (STEP*) as a function of the difference (λ).

Figure 6:
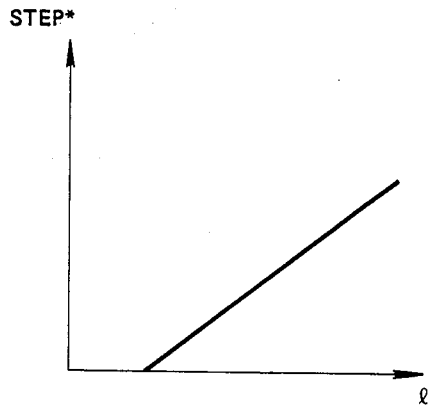
Figure 7:
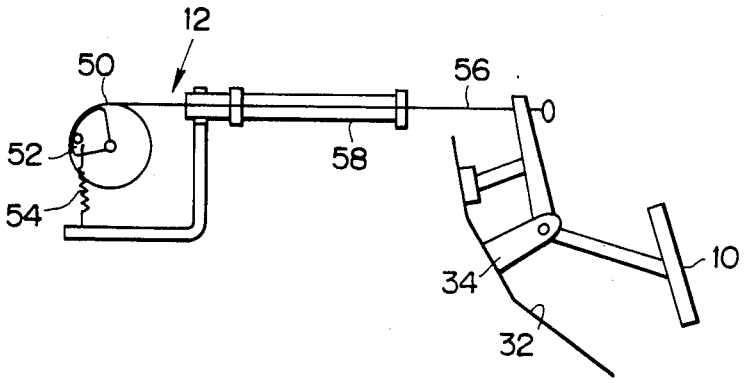
FIG. 7 is a schematic side view showing a modified form of the accelerator pedal position sensor.

If the central processing unit calculates a required new setting (STEP*) from the relationship shown in FIG. 6, the throttle valve 26 will remain still when the calculated difference (λ) is small. This is effective to avoid direct reflection of piecemetal accelerator pedal position changes made by an unskilled operator on the movement of the throttle valve to cause discomfort piecemetal vehicle speed changes. The same effect may be obtain by connecting the accelerator pedal 10 to the accelerator pedal position sensor 12 in such a manner as shown in FIG. 7 where the accelerator pedal position sensor 12 includes a potentiometer 50. The potentiometer 50 has a rotary sector 52 which constitutes the wiper arm of the potentiometer. The rotary sector 52 is connected with a play to the accelerator pedal 10 by a wire 56 which extends through a guide 58. A return spring 54 urges the rotary sector 52 in a direction returning the accelerator pedal 10 to its released position. The resistance of the potentiometer 50 is a function of the extent to which the rotary sector 52 is rotated.

At the point 412, the central processing unit 16 calculates a difference (ε) of the actual number of steps (STEP) at which the stepper motor is positioned from the required step number (STEP*). The sign of the calculated difference (ε) is positive when the required new setting (STEP*) is greater than the stepper motor actual position (STEP) and it is negative when the former is less than the latter. At the point 414, the direction in which the stepper motor 24 is to rotate is determined from the sign of the calculated difference (ε). The stepper motor 24 is to rotate in a direction moving the throttle valve in an opening direction when the calculated difference (ε) has a positive sign and in the opposite direction moving the throttle valve in a closing direction when the calculated difference (ε) has a negative sign. At the point 418, the central processing unit transfers the calculated values of the direction and step number to the digital-to-analog converter 20. The digital-to-analog converter 20 causes the stepper motor drive circuit 22 to make a change in the position of the throttle valve 26 if this is required.

Figure 8:
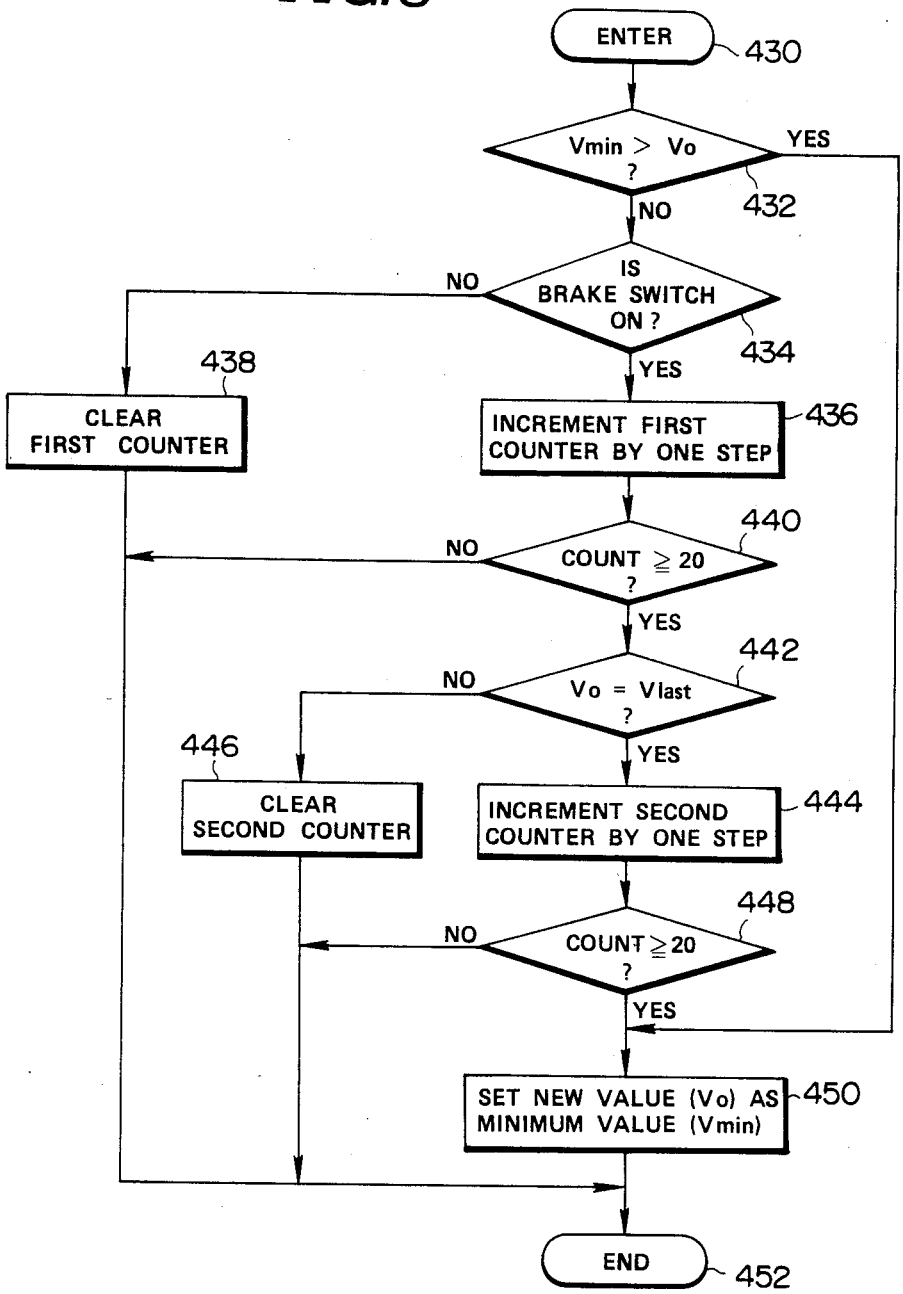
FIG. 8 is a detailed flow diagram showing the programming of the digital computer as used to set a minimum value for the position of the accelerator pedal.

FIG. 8 is a flow diagram illustrating the detail of the above calculation at the point 406 in the program of FIG. 4. At the point 430 in FIG. 8, which corresponds to the point 404 of FIG. 4, the computer program is entered. At the point 432, a determination is made as to whether or not the accelerator pedal position minimum value (Vmin) is greater than the accelerator pedal position new value (Vo). If the answer to this question is "yes", then the program proceeds to the point 450 where the new value (Vo) is set as the minimum value (Vmin). Otherwise, the program proceeds to the point 434 where a determination is made as to whether or not the brake switch 38 is on. This determination is made based upon the level of the signal V3 fed from the brake switch 38. If the answer to this question is "yes", then it means that braking is applied to the vehicle and the program proceeds to the point 436 where the central processing unit commands a first counter to count up by one step. Otherwise, the program proceeds to the point 438 and then to the end point 452. At the point 438, the first counter is cleared to zero.

At the point 440 in the program, a determination is made as to whether or not the count on the first counter is equal to or greater than 20. If the answer to this question is "yes", then it means that the brake switch remains on for a time equal to or greater than 100 milliseconds and the program proceeds to the point 442. Otherwise, the program proceeds to the end point 454.

At the point 442 in the program, a determination is made as to whether or not the new value (Vo) is equal to the last value (Vlast) for the position of the accelerator pedal. If the answer to this question is "yes", then the program proceeds to the point 444 where the central processing unit commands a second counter to count up by one step. Otherwise, the program proceeds to the point 446 and then to the end point 452. At the point 446, the second counter is cleared to zero.

At the point 448 in the program, a determination is made as to whether or not the count on the second counter is equal to or greater than 20. If the answer to this question is "yes", then it means that the accelerator pedal is at the same position for a time equal to or greater than 100 milliseconds and the program proceeds to the point 450 and then to the end point 452. At the point 450, the new value (Vo) is set as the minimum value (Vmin). Otherwise, the program proceeds to the end point 452. In other words, the new value (Vo) is set as a minimum value (Vmin) when the new value is less than the minimum value (Vmin) set in the previous cycle of execution of the program or when the brake pedal is depressed for a time greater than a predetermined value (100 milliseconds in this embodiment) and the accelerator pedal position remains unchanged for a time greater than a predetermined value (100 milliseconds in this embodiment).

Since the return spring 36 urges the accelerator pedal 10 toward its released position, the accelerator pedal minimum position will automatically come into coincidence with the accelerator pedal released position. As a result, the throttle valve 26 is controlled in accordance with the amount (Vo) of depression of the accelerator pedal 10 with respect to the position at which the accelerator pedal 10 is released. This control is effective to absorb errors occuring upon mounting the accelerator pedal position sensor 12 in place on the vehicle floor panel so as to provide high sensor mounting efficiency.

It may be considered that the accelerator pedal 10 cannot return further if the accelerator pedal position is constant when the brake pedal is depressed for application of braking to the vehicle, that is, the accelerator pedal 10 is released. In such an instance, the existing minimum value (Vmin) is replaced by the new value (Vo). If the resilient force of the return spring 36 becomes weaken to an extent insufficient to return the accelerator pedal 10 to the position indicated by the minimum value (Vmin), the position to which the accelerator pedal 10 can return under the force of the return spring 36 will be set as an accelerator pedal position minimum value. This ensures that the throttle valve 26 can move to its closed position so as to place the engine into an idling condition whenever the accelerator pedal 10 is released. Furthermore, it is possible to increase the accuracy of response of the throttle valve movement with respect to the amount of depression of the accelerator pedal 10.

Although the brake switch 38 is used to detect whether or not the accelerator pedal 10 is released, it is to be noted that the brake switch 38 may be replaced by a throttle switch which can cause a signal in response to closure of the throttle valve 26. In this case, the central processing unit 16 makes the determination at the point 434 of FIG. 8 based upon the signal fed from the throttle switch.

Figure 9:
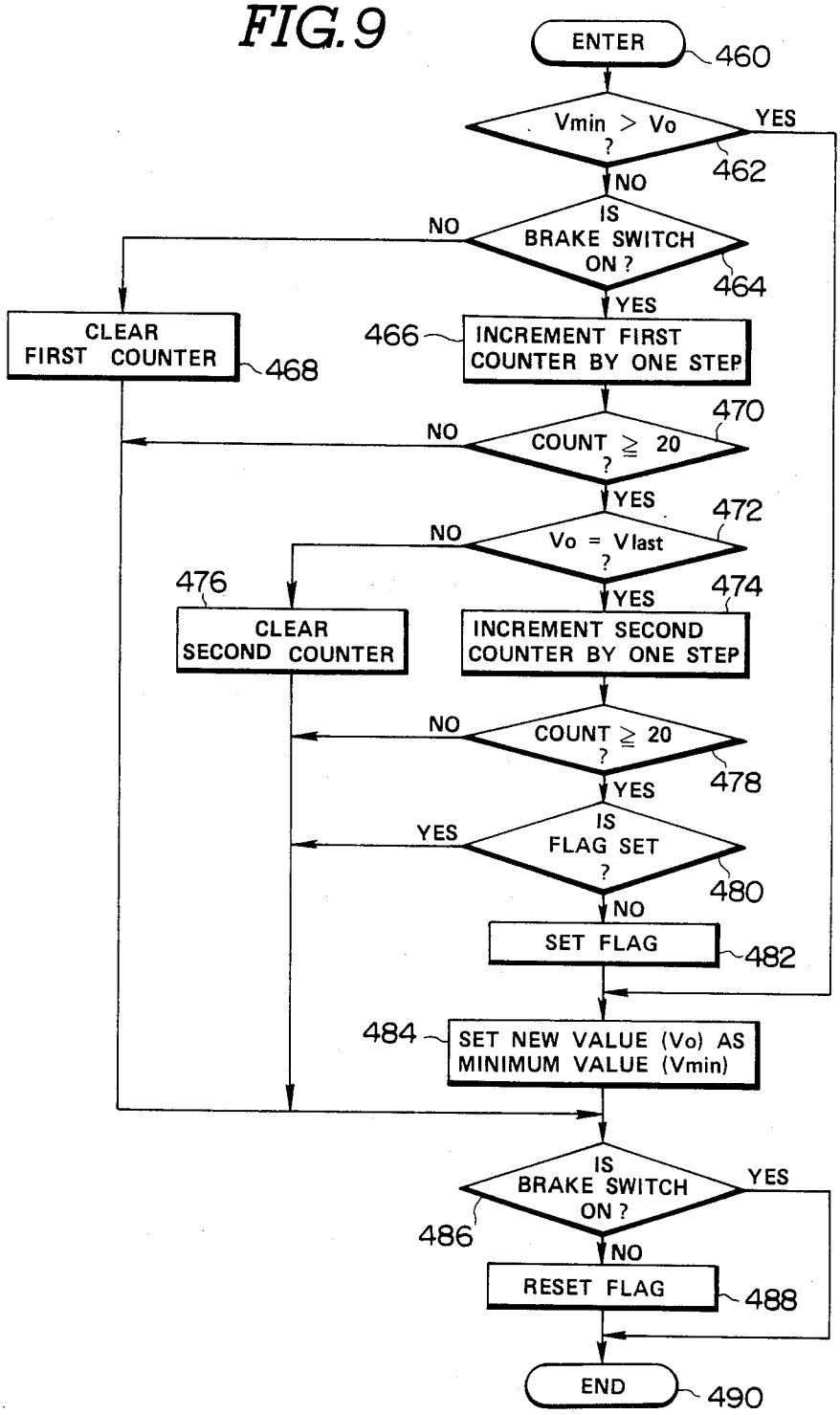
FIG. 9 is a detailed flow diagram showing a modified form of the programming of the digital computer as used to set a minimum value for the position of the accelerator pedal position.

FIG. 9 is a flow diagram of the programming of the digital computer used in a modified form of the control circuit. This flow diagram includes points 460 to 478, 484 and 490 which are substantially identical to the points 430 to 452 of FIG. 8 and also includes additional points 480, 482, 486 and 488 which are effective to inhibit replacement of the existing minimumn value (Vmin) with a new value (Vo) until the switching operation of the brake switch 38 is confirmed when the new value (Vo) is equal to or greater than the minimum value (Vmin).

At the point 480 in the program, a determination is made as to whether or not a flag, which indicates that the brake switch 38 remains on, is set. If the answer to this question is "yes", then the program jumps the point 484 and proceeds to the point 486. In other words, the new value (Vo) is not set as a minimum value (Vmin) if the brake switch 38 is not in its off state in the previous cycle of execution of the program. Otherwise, the program proceeds to the point 482 where the flag is set and then to the point 484 where the new value (Vo) is set as a minimum value (Vmin).

At the point 486 in the program, a determination is made as to whether or not the brake switch is on. If the answer to this question is "yes", then the program proceeds directly to the end point 490. Otherwise, the program proceeds to the point 488 where the flag is reset.

In this modification, the central processing unit sets the flag when a new value, which is equal to or greater than the existing minimum value, is substituted for the existing minimum value (Vmin) and resets the flag when the brake switch is changed to its off state. If the brake switch 38 remains on for any of reasons, the central processing unit inhibits substitution of a new value for the existing minimum value (Vmin) as long as the new value is equal to or greater than the existing minimum value (Vmin). This is effective to permit control of the throttle valve in response to a change in the position of the accelerator pedal 10 so that the driver can drive the vehicle to a place convenient for repair when the brake switch 38 is subject to failure such as contact fault. Although the brake switch 38 is used to sense whether or not the accelerator pedal 10 is released, it is to be noted that the brake switch 38 may be replaced by a throttle switch which can cause a signal in response to closure of the throttle valve 26. In this case, the central processing unit 16 performs the determinations at the points 464 and 486 of FIG. 9 based upon the signal fed from the throttle switch.

There has been provided, in accordance with the present invention, a throttle valve control apparatus which determines a setting of the position of the throttle valve as a function of a difference between new and minimum values for the position of the accelerator pedal. This is effective to absorb errors occuring upon attaching an accelerator position sensor to provide a high degree of accuracy of throttle valve control and provide high sensor mounting efficiency. In addition, the new value is substituted for the minimum value when the accelerator remains released and placed at the same position for a predetermined time. This ensures that the throttle valve can move to its closed position so as to place the engine into an idling condition whenever the accelerator pedal is released and is effective to avoid abnormal engine speed increases not intended by the operator in the event of failure of the return spring used to urge the accelerator pedal to its released position.

What is claimed is:

1. An apparatus for use with an internal combustion engine having an accelerator, a throttle value situated within an induction passage, and a brake pedal for controlling movement of said throttle valve in response to a change in the position of said accelerator, comprising:

a first signal source (12) for generating a first electrical signal indicative of the position of said accelerator (10);

a second signal source (38) for generating a second electrical signal indicative of said accelerator being released;

a control circuit (14) including means responsive to said first signal for determining an existing value for accelerator position and a minimum value for accelerator position, means for determining a demand value corresponding to a setting of the position of said throttle valve as a function of a difference between said existing and minimum values, and means responsive to said first and second signals for substituting said existing value for said minimum value when the accelerator remains released and placed at the same position for a predetermined time;

a throttle actuator (22, 24) connected to said control circuit for moving said throttle valve to said determined setting.

2. The apparatus as claimed in claim 1, wherein said second signal source includes a brake switch (38) operable to change from one state to another during application of braking to a vehicle.

3. The apparatus as calimed in claim 2, wherein said control circuit includes means for inhibiting substitution of said existing value for said minimum value when said brake switch remains at said another state.

4. The apparatus as claimed in claim 1, wherein said second signal source includes a throttle switch operable to change from one state to another when said throttle valve arrives at its closed position.

5. The apparatus as claimed in claim 4, wherein said control circuit includes means for inhibiting substitution of said existing value for said minimum value when said throttle switch remains at said another state.

6. The apparatus as claimed in claim 1, wherein said control circuit includes means for sampling said accelerator position indicative signal at predetermined time intervals, means for determining new and minimum values of the samples of said accelerator pedal position indicative signal, means for calculating a difference between said new and minimum values, means for determining a demand value corresponding to a setting of the position of said throttle valve as a function of said calculated difference, and means for substituting said new value for said minimum value when the accelerator remains released for a predetermined time and said new value remains constant for a predetermined time.

7. The apparatus as claimed in claim 6, wherein said second signal source includes a brake switch (38) operable to change from one state to another during application of braking to a vehicle.

8. The apparatus as claimed in claim 7, wherein said control circuit includes means for inhibiting substitution of said new value for said minimum value when said brake switch remains at said another state.

9. The apparatus as claimed in claim 6, wherein said second signal source includes a throttle switch operable to change from one state to another when said throttle valve arrives at its closed position.

10. The apparatus as claimed in claim 9, wherein said control circuit includes means for inhibiting substitution of said new value for said minimum value when said throttle switch remains at said another state.

11. The apparatus as claimed in claim 1, wherein said control circuit includes means for determining a demand value corresponding to a setting of the position of said throttle valve as a linear function of said calculated difference.

12. The apparatus as claimed in claim 11, wherein said control circuit includes means for maintaining said demand value at zero until said calculated difference exceeds a predetermined value.

* * * * *